United States Patent [19]

Schwarzkopf

[11] 4,103,132

[45] Jul. 25, 1978

[54] ROTARY SWITCH

[75] Inventor: Daniel Schwarzkopf, Hamden, Conn.

[73] Assignee: Unimax Switch Corporation, Wallingford, Conn.

[21] Appl. No.: 729,662

[22] Filed: Oct. 5, 1976

[51] Int. Cl.[2] ..... H01H 3/42; H01H 19/62

[52] U.S. Cl. ..... 200/153 LB; 200/6 B; 200/153 L; 200/157; 200/241; 200/250

[58] Field of Search ..... 200/6 B, 6 BA, 6 BB, 200/153 A, 153 K, 153 L, 153 LA, 153 LB, 157, 165, 241, 243, 245, 247, 250

[56] References Cited

U.S. PATENT DOCUMENTS

| | | | |
|---|---|---|---|
| 2,960,580 | 11/1960 | Aquillon | 200/153 LB X |
| 3,320,379 | 5/1967 | Franzene | 200/241 X |
| 3,719,788 | 3/1973 | Holland et al. | 200/153 LB |
| 3,725,624 | 4/1973 | Emmons | 200/153 LB X |
| 3,862,385 | 1/1975 | Johnson | 200/153 LB X |
| 3,971,904 | 7/1976 | Ward | 200/6 BB |
| 3,975,601 | 8/1976 | Whelan | 200/153 LB X |

*Primary Examiner*—Volodymyr Y. Mayewsky
*Attorney, Agent, or Firm*—Bernard Malina

[57] ABSTRACT

A rotary switch includes a contact bar movable between a switch-open and a switch-closed position and a rotatable circular cam member controlling the movement of said contact bar. Spring means urges the contact bar into operative engagement with the surface of said cam member. The cam member is rotatably contained within a cavity in the switch housing, the cavity having a wall surface guiding the cam member during rotation of the latter. Biasing action of the spring means upon said contact bar urges the cam member against the wall surface of said cavity, with said wall surface serving as the only bearing surface for said cam member during rotation of the latter. A pin and slot coupling is also provided as an integral portion of the cam member and housing to limit rotary movement of said cam member between precise switch-open and switch-closed positions.

18 Claims, 11 Drawing Figures

FIG. 1
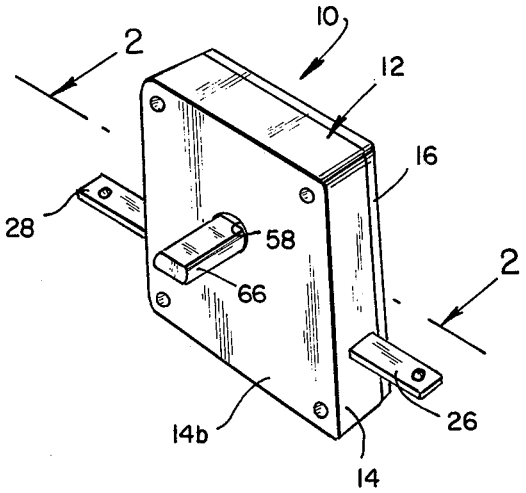
FIG. 2
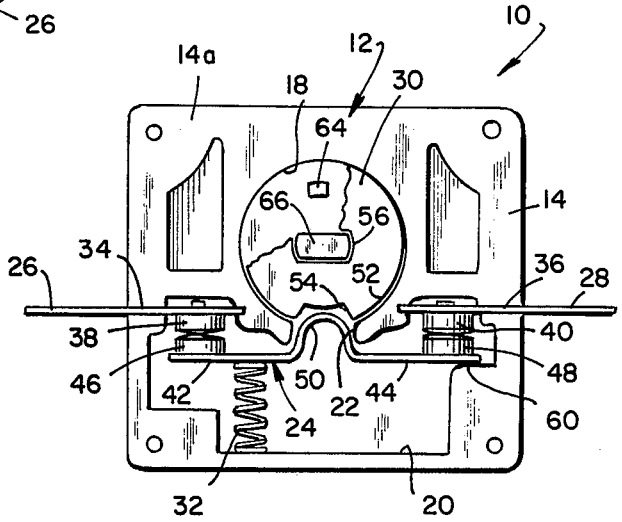
FIG. 5
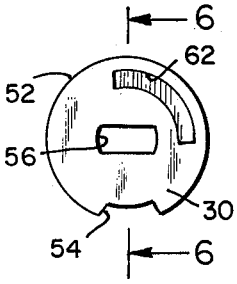
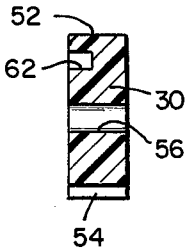
FIG. 6
FIG. 3
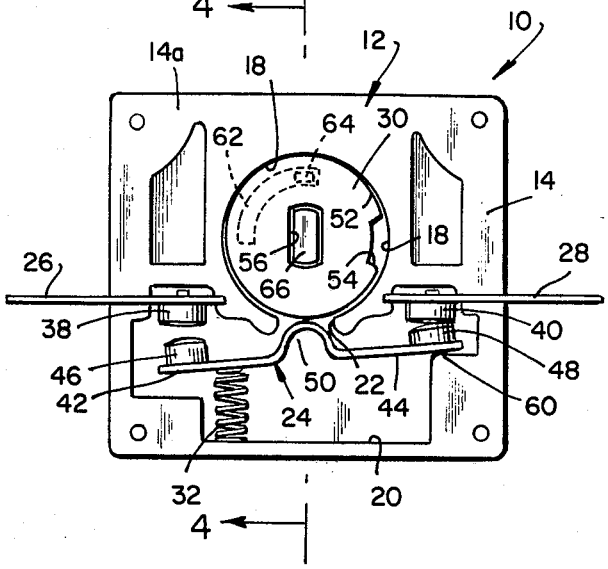
FIG. 4
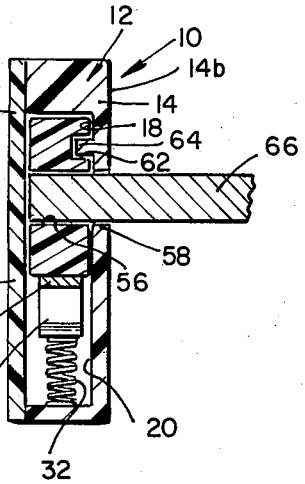

ROTARY SWITCH

BACKGROUND OF THE INVENTION

The present invention relates to improvements in electrical switches, and in particular to a novel and rotary improved rotary switch of the type utilizing a cam for actuation of the switch mechanism.

In many rotary switch devices, particularly in rotary safety switches, the switching mechanism is opened and closed by a cam mounted on a shaft, with the cam rotating about the shaft, or rotating with the shaft. In either instance, the operative relationship between the cam surface and the switching mechanism is dependent, at least in part, upon the accuracy of location of the shaft, and the aperture in the cam through which the shaft passes.

In many rotary switch devices, particularly those in which safety functions are included, the accuracy and precise control of the switching mechanism is very important. The mere fact that a switch device operates may not be sufficient; it must operate at the same proper position with each actuation.

Conventional rotary switches normally require the provision and use of separate additional parts and components for mounting and guiding the cam in its rotary movement. Such parts may be shafts and related holes, special hubs built onto the cams to serve as centers of rotation, or the like. These parts are not directly related to the proper positioning of the cam during the switching operation and tend to create inaccuracies in the cam positioning. Further, the provision of additional parts or components increases the cost of producing the switch.

It is an object of the present invention to provide a switch having a rotary cam, in which the cam is rotatably mounted in a cavity formed in the switch housing, with the actual cam surface guided by said cavity. Thus, the necessity for using additional parts to mount and guide the cam is eliminated.

Another object of the invention is the provision of a switch of the character described in which the accuracy and dependability of the switching operation is appreciably improved, since accuracy of the dimensional relationship between the working surfaces results from utilizing the camming surface of the cam, in association with a correspondingly-shaped housing cavity, for guidance of the cam throughout its entire rotational movement.

Another object of the invention is the provision of a switch of the character described in which internal means are provided to limit the rotation travel of the cam to precise, preselected extreme positions, in close relationship to the operating positions of the switching mechanism. This insures that a precise relationship exists between the actuator cam and the switch mechanism so that the switch functions at the proper time and functions properly each time it is operated.

A further object of the invention is the provision of a switch of the character described in which the rotation limiting means comprises a pin and slot connection between the rotary cam and the switch housing, such pin and slot being formed integrally with the cam and housing, thereby eliminating the necessity for providing additional parts for this purpose.

A further object of the invention is the provision of a switch of the character described in which the rotation limiting means and its associated switch parts also serve as external indicating means by which the proper extreme positions of the switch, in its open and closed conditions, may be determined.

BRIEF DESCRIPTION OF THE INVENTION

In accordance with the invention, there is provided an electrical switch comprising a housing member having an interior cavity bounded by a guide wall surface of arcuate configuration said guide wall surface having an opening therein, and a cam member comprising a disc having an arcuate peripheral surface portion and a dwell portion. The arcuate peripheral surface of said cam member is of smaller size than said cavity and is received in said cavity for rotation of said cam member therein. The switch also includes a switch mechanism mounted in said housing member for movement between a switch-open operating position and a switch-closed operating position, and having a portion extending through the opening in said guide wall surface into engagement with said cam member. Means are provided for rotating the cam member within said cavity between a first position in which the contact bar engages the peripheral surface of the cam member to provide one of said operating positions, and a second position in which the contact bar engages the dwell portion of the cam member to provide another one of said operating positions. The arcuate peripheral surface of said cavity serves as the only bearing surface for the cam member during rotation of the latter.

In one embodiment of the invention, limiting means are provided for restraining rotary movement of the cam member beyond preselected points in said first and second positions, said limiting means comprising a slot formed integrally in either the housing member or the cam member, and a pin formed integrally with the other member and projecting therefrom into said slot.

Additional objects and advantages of the invention will become apparent during the course of the following specification, when taken in connection with the accompanying drawings, in which:

FIG. 1 is a perspective view showing an electrical switch made in accordance with the present invention;

FIG.2 is a sectional view taken along line 2—2 of FIG. 1, and showing the switch parts in a switch-closed position;

FIG. 3 is a sectional view similar to FIG. 2, but showing the switch parts in a switch-open position;

FIG. 4 is a sectional view taken along line 4—4 of FIG. 3;

FIG. 5 is a plan view of the cam member of the switch shown in FIGS. 1-4;

FIG. 6 is a sectional view taken along line 6—6 of FIG. 5;

DETAILED DESCRIPTION OF THE INVENTION

Figure 7:
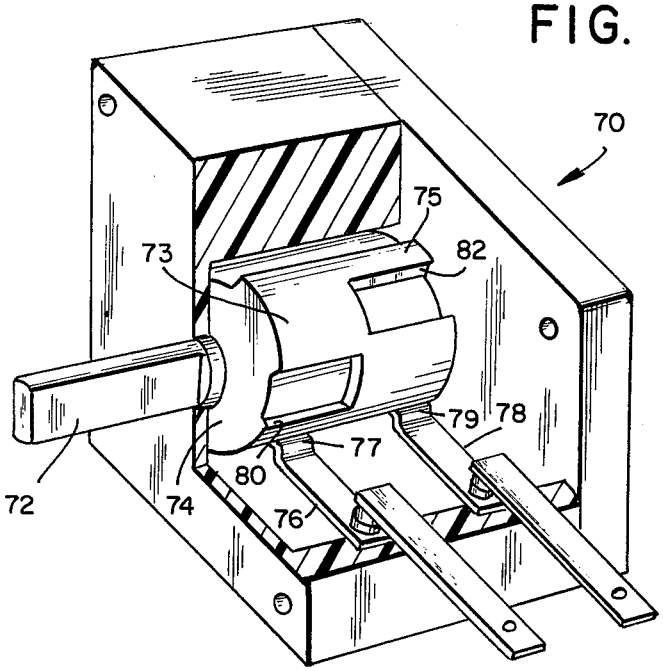
FIG. 7 is a perspective view of a double pole electrical switch in accordance with the present invention in a second embodiment thereof with the switch housing broken away to reveal the cam member and contact bars.

Referring in detail to the drawings, and in particular to FIGS. 1 and 2, there is shown a switch assembly 10 comprising a molded plastic housing 12 having appropriate electrical insulation properties. The housing 12 comprises a base element 14 and a cover plate 16 fitted upon and suitably secured to the base element.

The base element 14 is in the nature of a block of substantial thickness, having an inner planar surface 14*a* and an outer planar surface 14*b*. On its inner surface 14*a*, the base element 14 is molded with a circular cavity 18 and a generally rectangular, elongated cavity 20 communicating with the circular cavity 18 through a reduced neck portion 22. The cavities 18 and 20 house the switch components, as will be presently described. The cover plate 16 overlies and rests flush against the inner planar surface 14*a* of base element 14 to enclose the cavities 18 and 20.

The switch components comprise an electrically conductive contact bar 24, a pair of conductive terminal bars 26 and 28, a cam member 30, and a return spring 32. The terminal bars 26 and 28 are received within respective grooves 34 and 36 in the body of base element 14, whereby the terminal bars 28 and 30 are immovably mounted. The inner end portions of the terminal bars 26 and 28 extend into the elongated cavity 20 and mount respective stationary contacts 38 and 40. The outer ends of terminal bars 26, 28 extend through openings in the sides of base element 14 to the extension thereof, as shown in FIGS. 1, 2 and 3, being thus accessible for connection to electrical leads to control the current flow therethrough.

The contact bar 24 has aligned, oppositely, extending arms 42 and 44, at the ends of which respective contacts 46 and 48 are mounted. At its center, the contact bar 44 is formed with an upstanding projection 50 of inverted U-shape. The contact bar 44 is mounted within the elongated cavity 20 beneath the terminal bars 26, 28, with the return spring 32 supporting the contact bar in mounted position. One end of return spring 32 is seated upon the bottom wall of cavity 20, and its other end engages the under surface of contact bar arm 42 to urge the contact bar in an upward direction with the projection 50 extending upwardly through the neck portion 22 and the movable contacts 46, 48 in firm engagement with the fixed contacts 38, 40.

The cam member 30 is in the form of a circular disc having a circular peripheral surface 52 interrupted by an elongated notch or recess 54. It is understood that cam member 30 may be provided with a plurality of angularly spaced notches 54 as required by the intended function of the switch. A through-bore or aperture 56 extends centrally through the cam member 30, and is of noncircular shape, for example, of rectangular shape as shown in FIG. 5. The diameter of cam member 30 is slightly less than the diameter of the circular cavity 18 so that the cam member 30 fits rotatably within said circular cavity, with a slight amount of clearance therein.

In the mounted position of the cam member 30, the central bore 56 registers with a circular opening 58 in the outer planar surface 14b of the housing base element 14. One end of an actuator shaft 66, having the same cross-sectional configuration as the bore 56, is received in said bore 56, the actuator shaft extending through the circular opening 58 and projecting exteriorly of the switch housing 12. When the actuator shaft 66 is turned, the cam member 30 is rotated within the circular cavity 18.

FIG. 2 shows the switch assembly 10 in closed condition, with the cam member 30 disposed in its normal condition in which the elongated notch 54 is in registry with the central projection 50 of the contact bar 24. The return spring 32 biases the contact bar 24 in an upward direction, with the tip of projection 50 engaging and pressing against the inner wall of notch 54. The notch 54 is of sufficient depth that, in this position, the movable contacts 46, 48 are pressed firmly against the respective fixed contacts 38, 40, in flush engagement therewith, under the biasing force of return spring 32. The terminals 26 and 28 are thus electrically connected through the contact bar 44.

When the actuator shaft 66 is turned to rotate the cam member 30, for example in a counter-clockwise direction, the switch assembly 10 is brought to the open position shown in FIG. 3. As the cam member 30 rotates, the elongated notch 54 moves out of registry with the contact bar projection 50, and the latter engages and rides along the circular peripheral surface 52 of cam member 30, which acts as a cam surface to depress the cam member projection 50 and thus move the cam member 24 downwardly against the biasing force of spring 32.

It will be seen in FIGS. 2 and 3 that a wall surface 60 of the elongated cavity 20 underlies the free outer end of the contact bar arm 44 and is sufficiently close to limit the vertically downward movement of arm 44 to a position in which the movable contact 48 limits the separation from the fixed contact 40. Consequently, when the projection 50 is depressed by the surface 52 of cam member 30, the contact bar 24 is moved downwardly to the inclined position shown in FIG. 3 in a tilting action in which the movable contact 48 is the fulcrum. On the other hand, the contact bar arm 42 moves downwardly an appreciable distance and the movable contact 46 is well separated from the fixed contact 38. The switch assembly 10 is thus in open condition since the terminals 26 and 28 are no longer electrically connected by the contact bar 24.

If the switch assembly 10 is made with only the structure heretofore described, and without the rotation limiting means to be presently described, it will be observed that the cam member 30 may be turned in either a clockwise or counter-clockwise direction. Rotation of the cam member in either direction from the switch closed position of FIG. 2 will move the elongated notch 54 out of registry with the contact bar projection 50 and bring the circular cam surface 52 into engagement with said projection 50, thus separating the contacts 38, 46 to open the switch in an identical action.

An advantageous feature of the invention is the provision of the circular cavity 18 in the housing 12 to properly locate and guide the movement of the circular cam member 30 during all phases of the switch operation. As previously indicated, the circular cavity 18 is of slightly larger diameter than that of the cam member 30, so that the cavity receives the cam member 30 therein with some freedom of movement of the latter in all directions. The return spring 32 normally biases the cam member 30 vertically in an upward direction, as viewed in FIG. 2, so that the cam member bears against the top surface of the circular cavity 18. Thus the location of the cam member 30 in an upward direction is fixed by the circular cavity and no other parts arc required for establishing the location of the camming surfaces with respect to the switching elements, as are required in conventional switches of this type.

As the cam member 30 is rotated in either a clockwise or counter-clockwise direction, the force of the rotating cam member will be applied to the right or left side of the circular cavity 18 instead of to the top. Since this force is applied by the cam member against the continuous wall of the circular cavity, the latter provides precise and accurate guidance of the cam member, in any of its rotated positions, relative to its associated switch mechanism. Where, as in the illustrated embodiment, the return spring 32 applies a substantial upward biasing force upon the cam member 30 to maintain the cam member pressed against the upper wall surface of the circular cavity 18, said cavity need only extend around approximately 180° of the circumference of the cam member and may thus have a large lower opening or openings. On the other hand, if the cam member is subjected to negligable upward biasing force, the circular cavity must have an enclosing surface of about 270° to insure that the cam member is retained in said cavity, and does not drop therefrom under force of gravity.

The switch assembly 10 may also be provided with rotation limiting means as an optional feature, where it is desired to restrict the turning movement of the cam member 30 to a limited angular extent which is closely confined to the operating positions of the switch mechanism. For this purpose, an arcuate slot 62 is formed in the cam member 30 on the surface thereof which is adjacent and parallel to the housing base element 14. A stop pin 64 projects from the confronting surface of the base element 14 within the circular cavity 18, and is positioned to extend into the arcuate slot 62, as shown in FIGS. 3 and 4.

In the illustrated embodiment, the slot 62 is made as a circular arc of 90° extent and is so positioned that the stop pin 64 is located at one end of the slot 62 in the switch-closed position of FIG. 2, and at the opposite end of the slot in the switch-open position of FIG. 3. The stop pin 64 and slot 62 thus cooperate to limit turning movement of the cam member 30 to a counter-clockwise direction when the cam member is to be turned from its switch-closed position of FIG. 2 to its switch open position of FIG. 3. The pin 64 and slot 62 also insure that the cam member 30 cannot be turned past either of the operative positions shown. Thus if the arcuate slot 62 is selectively provided with a length of 90° plus an allowance for the thickness of pin 64, the cam member 30 and its elongated recess 54, are rotated precisely 90° between the open and closed switch positions. Thus, the extreme travel positions of the cam member 30, and the actuator shaft 66 which rotates with it, are fixed permanently by the stop pin 64 and arcuate slot 62. The actuator shaft 66 also serves as indicator means for visually determining whether the switch is in open or closed position, since its angular orientation is positively related to the operating positions of the switch mechanism. The use of the switch assembly as a safety switch would be defeated it it were possible to bring the actuator shaft to a false position which could permit either an incorrect function or indication. With the limiting means shown herein, it is impossible to turn the actuator shaft to such false position.

It will be understood that the length and positioning of the arcuate slot 62 may be varied to selectively establish other extreme switch positions. In addition, the switch housing may be provided with a series of openings into one or more of which stop pins may be selectively inserted and secured to provided variation in travel and relative positions of the switch elements, and to enable the same cam member to be used in switches having different functions.

It will be obvious that the locations of the circular slot 62 and stop pin 64 may be reversed, that is the slot may be formed in the surface of the housing base element 14 and the pin may be molded on the confronting surface of the cam member 30 to provide the same operation as previously described. In either instance, the elements of the rotation limiting means are provided as integral parts of the housing and cam member, and no additional parts are required.

Although only a single stop pin 64 is shown in FIGS. 2–4, it will be understood that electrical switch 10 may include a second similar stop pinn angularly spaced from pin 64 to act on the opposite end of slot 62 and thereby provide a sturdier limit stop construction.

Figure 8:
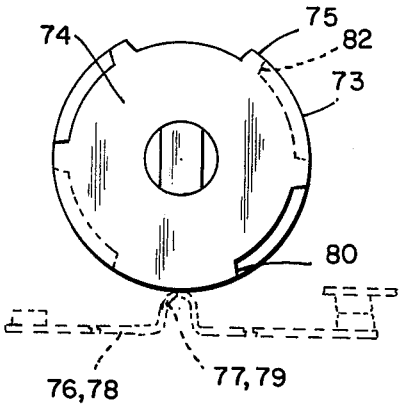
FIG. 8 is a sectional view taken along line 8—8 of FIG. 7.

It is understood that while a single-cam single-pole switch 10 has been described hereinabove and shown by way of example in FIGS. 1–6 it is understood that the present invention may be applied to a single cam multi-pole switch 70 shown in FIGS. 7 and 8 and a ganged array 90 of the single-cam single-pole switches shown in FIGS. 9–11.

Thus, in FIG. 7, switch 70 comprises a single actuator shaft 72 mounting a single-cam member 74 acting on a pair of laterally spaced contact bars 76 and 78 each of which is similar to contact bar 24 described hereinabove. Cam member 74 is similar in construction to cam member 30 of FIGS. 2 and 3 except that cam member 74 includes two track areas 73, 75 laterally spaced on the circular peripheral surface of cam member 74 for engagement with the upstanding projections 77 and 79 of contact bars 76 and 78 respectively. Track 73 is provided with one or more notches 80 which act on projection 77 of contact bar 76 and track 75 is similarly provided with one or more notches 82 acting on projection 79 of contact bar 78. It is understood that switch 70 may have a cam member with a greater number of track areas and a corresponding number of contact bars to provide a multi-pole switch as required.

Figure 9:
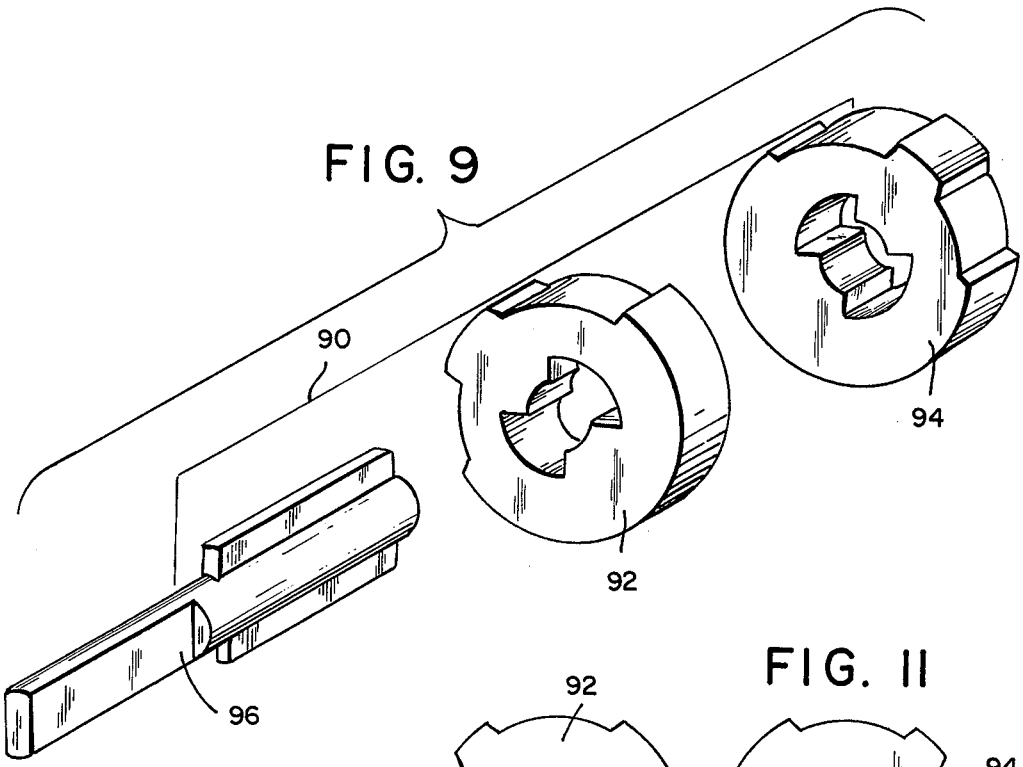
FIG. 9 is an exploded view of ganged double pole electrical switch in accordance with the present invention in a third embodiment thereof.
Figure 10:
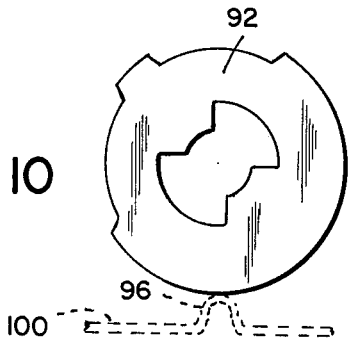
FIGS. 10 and 11 are elevational views of the cams shown in FIG. 9.
Figure 11:
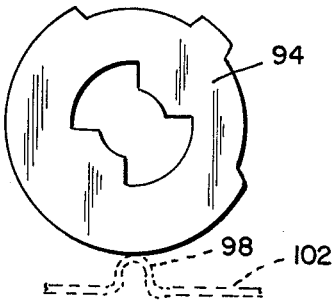

In another embodiment of the present invention, shown in FIGS. 9–11, an electrical switch 90 comprises a pair of ganged cam members 92 and 94 mounted on a single actuator shaft 96 for engagement with a corresponding pair of upstanding projections 96 and 98 of contact bars 100 and 102 respectively, the multiple cam members and contact bars being enclosed in a single switch housing (not shown) of the type shown in FIG. 1. It is understood that switch 90 may comprise a greater number of cam members and a corresponding number of contact bars to provide a mutli-pole electrical switch.

While preferred embodiments of the invention have been shown and described herein, it is obvious that numerous ommissions, changes and additions may be made in such embodiments without departing from the spirit and scope of the invention.

What is claimed is:

1. An electrical switch comprising a housing member of electrically insulating material having an interior cavity bounded by a guide wall surface of circular configuration, said guide wall surface having an opening therein, a cam member of electrically insulating material comprising a disc having a generally circular peripheral camming surface with a dwell portion, the circular peripheral surface of said cam member being of slightly smaller size than said cavity, and being closely received and rotatably mounted in said cavity with said guide wall surface serving as the bearing surface for said cam member, a fixed contact within the interior of said housing member, switch contact means including a movable contact mounted in said housing member adjacent said fixed contact for movement between a switch-closed operating position in engagement with said fixed contact and a switch-open-operating position out of engagement with said fixed contact, said switch contact means having a portion thereof extending through the opening in said guide wall surface into engagement with said cam member, means for rotating said cam member within said cavity between a first position in which said switch contact means engages the circular peripheral surface of said cam member to provide one of said operating positions, and a second position in which said switch contact means engages the dwell portion of said cam member to provide the other of said operating positions.

2. An electrical switch according to claim 1 in which said dwell portion of said cam member is a notch.

3. An electrical switch according to claim 2 in which said guide wall surface has an extent of at least 180°.

4. An electrical switch according to claim 2 in which said guide wall surface has an extent of at least 270°.

5. An electrical switch according to claim 2 in which said switch contact means has a projecting portion extending through said guide wall opening and sized to extend witin the notch of said cam member.

6. An electrical switch according to claim 5 which also includes biasing means urging said switch contact means in a direction in which the projecting portion of said switch contact means engages the peripheral surface of said cam member.

7. An electrical switch according to claim 6 in which the projection portion of said switch contact means extends into the notch of said cam member when the latter is in said second position, said projecting portion engaging the peripheral surface of said cam member exteriorly of said notch in said first position of said cam member, thereby to separate said movable contact from said fixed contact to establish said switch-open position.

8. An electrical switch according to claim 1 in which said switch contact means, under force of said biasing means, presses said cam member against said guide wall surface in both switch-open and switch-closed positions.

9. An electrical switch according to claim 1 in which said cam member has a central opening therein and said switch also includes an actuator shaft secured within said central opening and projecting exteriorly of said housing for rotation of said cam member between said first and second positions.

10. An electrical switch according to claim 1 wherein said guide wall surface serves as the only bearing surface for said cam member during rotation of the latter.

11. An electrical switch according to claim 7 wherein said switch contact means comprises an elongated contact bar.

12. An electrical switch comprising a housing member of electrically insulating material having an interior cavity bounded by a guide wall surface of circular configuration, said guide wall surface of circular configuration, said guide wall surface having an opening therein, a cam member of electrically insulating material comprising a disc having a generally circular peripheral camming surface with a dwell portion, the circular peripheral surface of said cam member being of slightly smaller size than said cavity, and being closely received and rotatably mounted in said cavity with said guide wall surface serving as the bearing surface for said cam member, a fixed contact within the interior of said housing member, switch contact means including a movable contact mounted in said housing member adjacent said fixed contact for movement between a switch-closed operating position in engagement with said fixed contact and a switch-open operating position out of engagement with said fixed contact, said switch contact means having a portion thereof extending through the opening in said guide wall surface into engagement with said cam member, means for rotating said cam member within said cavity between a first position in which said switch contact means engages the circular peripheral surface of said cam member to provide one of said operating positions, and a second position in which said switch contact means engages the dwell portion of said cam member to provide the other of said operating positions, and limiting means for restraining rotary movement of said cam member beyond preselected points in said first and second positions, said limiting means comprising an elongated slot formed integrally in one of said housing and cam members.

13. An electrical switch according to claim 12 wherein said limiting means includes a stop member extending in a direction parallel to said guide wall surface and said camming surface from the other of said members and projecting into said slot.

14. An electrical switch according to claim 13 wherein said stop member comprises a pin.

15. An electrical switch according to claim 14 in which said pin is formed integrally with said housing member within said cavity, and said slot is formed in said cam member.

16. An electrical switch according to claim 13 wherein said slot is of arcuate configuration and is formed in a surface of one of said members and said stop member projects from the facing surface of the other of said members into said slot.

17. An electrical switch according to claim 12 wherein said guide wall surface serves as the only bearing surface for said cam member during rotation of the latter.

18. An electrical switch according to claim 12 in which said cam member has a central opening therein and said switch also includes an actuator shaft secured within said central opening and projecting exteriorly of said housing for rotation of said cam member between said first and second positions.

* * * * *